US007410364B2

(12) United States Patent
Kishi et al.

(10) Patent No.: US 7,410,364 B2
(45) Date of Patent: Aug. 12, 2008

(54) CONNECTOR WITH HEADER CONNECTOR AND SOCKET CONNECTOR THAT ARE MECHANICALLY AND ELECTRICALLY CONNECTED WITH EACH OTHER

(75) Inventors: Masanori Kishi, Tsu (JP); Kenji Okura, Tsu (JP)

(73) Assignee: Matsushita Electric Works, Ltd., Kadoma-shi (JP)

( * ) Notice: Subject to any disclaimer, the term of this patent is extended or adjusted under 35 U.S.C. 154(b) by 0 days.

(21) Appl. No.: 11/634,115

(22) Filed: Dec. 6, 2006

(65) Prior Publication Data

US 2007/0141866 A1 Jun. 21, 2007

(30) Foreign Application Priority Data

Dec. 15, 2005 (JP) ..... 2005-362173

(51) Int. Cl.
*H01R 12/00* (2006.01)

(52) U.S. Cl. ..... 439/74; 439/660; 439/570; 439/566

(58) Field of Classification Search ..... 439/74, 439/660, 566, 570
See application file for complete search history.

(56) References Cited

U.S. PATENT DOCUMENTS 5,885,092 A * 3/1999 Ito et al. ..... 439/74
5,975,916 A 11/1999 Okura et al.
6,338,630 B1 * 1/2002 Dong ..... 439/74
6,692,266 B2 * 2/2004 Hashiguchi et al. ..... 439/74
6,729,890 B2 * 5/2004 Shin ..... 439/74
6,793,506 B1 * 9/2004 Hirata et al. ..... 439/74
6,881,075 B2 * 4/2005 Huang et al. ..... 439/74
7,118,388 B2 * 10/2006 Midorikawa et al. ..... 439/74

FOREIGN PATENT DOCUMENTS

JP 10-162913 6/1998
JP 2004-55463 2/2004

OTHER PUBLICATIONS

European Search Report issued Jun. 11, 2007, during the prosecution of European Application No. 06025120.4.

* cited by examiner

*Primary Examiner*—Neil Abrams
*Assistant Examiner*—Harshad C Patel
(74) *Attorney, Agent, or Firm*—Edwards Angell Palmer & Dodge LLP

(57) ABSTRACT

A connector comprising a header connector 20 and a socket connector 25. The connector 25 includes a fixed section 272 that is continuously formed at the tip of one end 2711 of a contact section 271 so that a part 2721 of the section 272 is arranged in parallel with the one end. A housing 26 of the connector 25 sandwiches and retains both sides of the part 2721 between a pair of facing retention grooves, and also sandwiches and receives both sides of the one end 2711 between a pair of facing guiding grooves so that the one end 2711 can move only along facing surfaces including the above each groove.

4 Claims, 8 Drawing Sheets

CONNECTOR WITH HEADER CONNECTOR AND SOCKET CONNECTOR THAT ARE MECHANICALLY AND ELECTRICALLY CONNECTED WITH EACH OTHER

TECHNICAL FIELD

The invention relates generally to connectors and more particularly to a connector comprising a header connector and a socket connector that are mechanically and electrically connected with each other.

BACKGROUND ART

This sort of connector is disclosed in, for example, Japanese Patent Application Publication No. 2004-55463. As shown in FIGS. 1A and 1B, this connector 1 comprises a header connector 10 and a socket connector 15.

The header connector 10 is constructed with a header housing 11 formed of electrically insulating material such as synthetic resins or the like and header contacts 12 each of which is made of a metal plate. The housing 11 is formed into a slender box shape with a base, and four walls (sides) along an insert direction. The contacts 12 are arranged and fixed at specified intervals on lengthwise walls 111 and 112 of the housing 11. That is, each contact 12 is bent so that both faces of a lengthwise wall are sandwiched between the bent two parts of the contact 12, and then is fixed on the wall. In the example of FIGS. 1A and 1B, the housing 11 retains P-shaped contacts 12 each of which foot section 123 as, for example, a lead connected to a printed circuit board sticks out sideways via a through hole of the housing 11.

The socket connector 15 is constructed with a socket housing 16 formed of electrically insulating material such as synthetic resins or the like and resilient socket contacts 17 each of which is made of a metal plate. The housing 16 is formed into a slender box shape of which four walls surround the walls of the housing 11 and of which base closes the opening of the housing 11. The contacts 17 are arranged and fixed at the above specified intervals on lengthwise walls 161 and 162 of the housing 16. Concretely, the housing 16 includes connection cavities 165 and 166 formed so that the walls 111 and 112 fixing the contacts 12 are inserted into the cavities 165 and 166 and pulled out thereof along the insert direction, respectively. Each contact 17 is formed to include a contact section 171, a fixed section 172 and a lead section 173. The contact section 171 is bent so that the contact 12 inserted into a corresponding connection cavity is sandwiched between both ends of the section 171 and the ends come in contact with the contact 12. Therefore, when the connectors 10 and 15 are combined with each other as shown in FIG. 1B, each resilient contact section 171 is elastically deformed to sandwich a corresponding contact 12 between both ends of the section 171 to come in contact therewith, while adding restoring force of the elastic deformation. The fixed section 172 is continuously formed at the tip of one end 1711 of the contact section 171 so that a part (one end) 1721 of the section 172 is arranged in parallel with the one end 1711. The lead section 173 is continuously formed at the tip of the part 1721 of the fixed section 172 so as to stick out sideways, and is connected to, for example, a printed circuit board. In addition, as shown in FIG. 2A, the housing 16 has channels (cf. a channel 161*a* in FIG. 2A) at intervals corresponding to the above specified intervals around each lengthwise wall (cf. 161 in FIG. 2A), and the channels individually receive the contacts 17. Accordingly, each contact 17 can be prohibited from moving lengthwise.

However, as shown in FIGS. 2B and 2C, each contact 17 cannot be prohibited from rotating around the direction perpendicular to the lengthwise walls in the structure that each contact 17 sandwiches a lengthwise wall between the one end 1711 of the contact section 171 and the part 1721 of the fixed section 172, and projections 1725 and 1726 formed at the part 1721 are pressed into the corresponding channel (cf. 161*a* in FIG. 2B). When at least a contact 17 tilts as shown in FIGS. 2B and 2C, the lead section 173 can not be properly soldered to a printed circuit board. Moreover, contact condition between the contact 17 and a corresponding contact 12 becomes unstable as well, and also unwanted load is added to the contact 17 when inserted into the connection cavity.

DISCLOSURE OF THE INVENTION

It is therefore an object of the present invention to properly fix at least a socket contact to a socket housing.

A connector of the present invention comprises a header connector and a socket connector. The header connector is constructed with a header housing and at least a header contact. The header housing includes a wall along an insert direction. The header contact is bent so that both faces of the wall are sandwiched between the bent two parts of the contact, and is fixed on the wall. The socket connector is constructed with a socket housing and at least a resilient socket contact. The socket housing includes a connection cavity formed so that the wall fixing the header contact is inserted into the cavity and pulled out thereof along the direction. The socket contact includes a contact section bent so that the header contact inserted into the cavity is sandwiched between both ends of the contact section and the ends come in contact with the header contact. The socket connector further includes a fixed section that is continuously formed at the tip of one end of the contact section so that a part of the fixed section is arranged in parallel with the one end. In one aspect of this invention, the socket housing is formed with a pair of facing retention grooves and a pair of facing guiding grooves along the direction on facing surfaces in the cavity, respectively. The socket housing sandwiches and retains both sides of the part of the fixed section between the retention grooves, and also sandwiches and receives both sides of the one end of the contact section between the guiding grooves so that the one end of the contact section can only move along the above facing surfaces in the cavity.

According to this invention, both sides of the part of the fixed section are sandwiched and fixed between the retention grooves, and also both sides of the one end of the contact section are sandwiched and received between the guiding grooves so that the one end of the contact section can only move along the above facing surfaces in the cavity, and therefore the socket contact can prohibited from rotating around the direction perpendicular to the wall. This is, the socket contact can be properly fixed to the socket housing.

In another aspect of the present invention, the socket housing further comprises a slot that has facing surfaces as said facing surfaces in the cavity. The slot is formed at the bottom and another facing surfaces in the cavity, and includes a through hole at the bottom side. In addition, the socket contact is put in the slot, and the retention grooves and the guiding grooves are opened toward the insert direction. According to this invention, it is possible to increase the size of the socket contact in the insert direction without increasing the size of the socket housing in the direction as compared with the structure that a socket contact comes in contact with the bottom of a connection cavity. Accordingly, it is possible to lengthen the insert length of the header contact into the contact section of the socket contact. In addition, since the socket housing can be compacted without shortening the size of the socket contact, in case that the socket housing is compacted in that way, it is possible to prevent wear-out caused by reduction of the socket contact.

In another aspect of the present invention, each of the guiding grooves has a width wider than the thickness of the one end of the contact section and has a buffer gap 269*c*' at side of the neighboring retention groove when the wall fixing the header contact is not inserted into the cavity. According to this invention, unwanted load can be prevented from adding to the socket contact when the wall fixing the header contact is inserted into the cavity and pulled out thereof. It is also possible to prevent excessive deformation of the socket contact.

In another aspect of the present invention, the both sides of the one end of the contact section are formed with a pair of guide projections that are guided along the guiding grooves and substantially come in contact with the guiding grooves, respectively. In addition, the both sides of the part of the fixed section are formed with a pair of guide projections guided along the retention grooves and a pair of retention projections pressed into the retention grooves, respectively. According to this invention, the socket contact can be properly fixed to the socket housing.

In another aspect of the present invention, the header housing further includes another wall along the insert direction, and the end face of the another wall is formed with a rack that sticks out along the insert direction. The socket housing further includes a receiving cavity in which said another wall is received. The bottom of the receiving cavity is formed with a pair of rack stoppers that stick out along the insert direction so that the tip of the rack is sandwiched between the stoppers when the wall fixing the header contact is inserted into the connection cavity. According to this invention, the header housing and the socket housing can be firmly fixed to each other. Moreover, around the rack stoppers each of which receives stress can be reinforced with the thickness thereof, and also molding is simple because of simple structure of drawing.

BRIEF DESCRIPTION OF THE DRAWINGS

Preferred embodiments of the invention will now be described in further details. Other features and advantages of the present invention will become better understood with regard to the following detailed description and accompanying drawings where.

BEST MODE FOR CARRYING OUT THE INVENTION

Figure 1A:
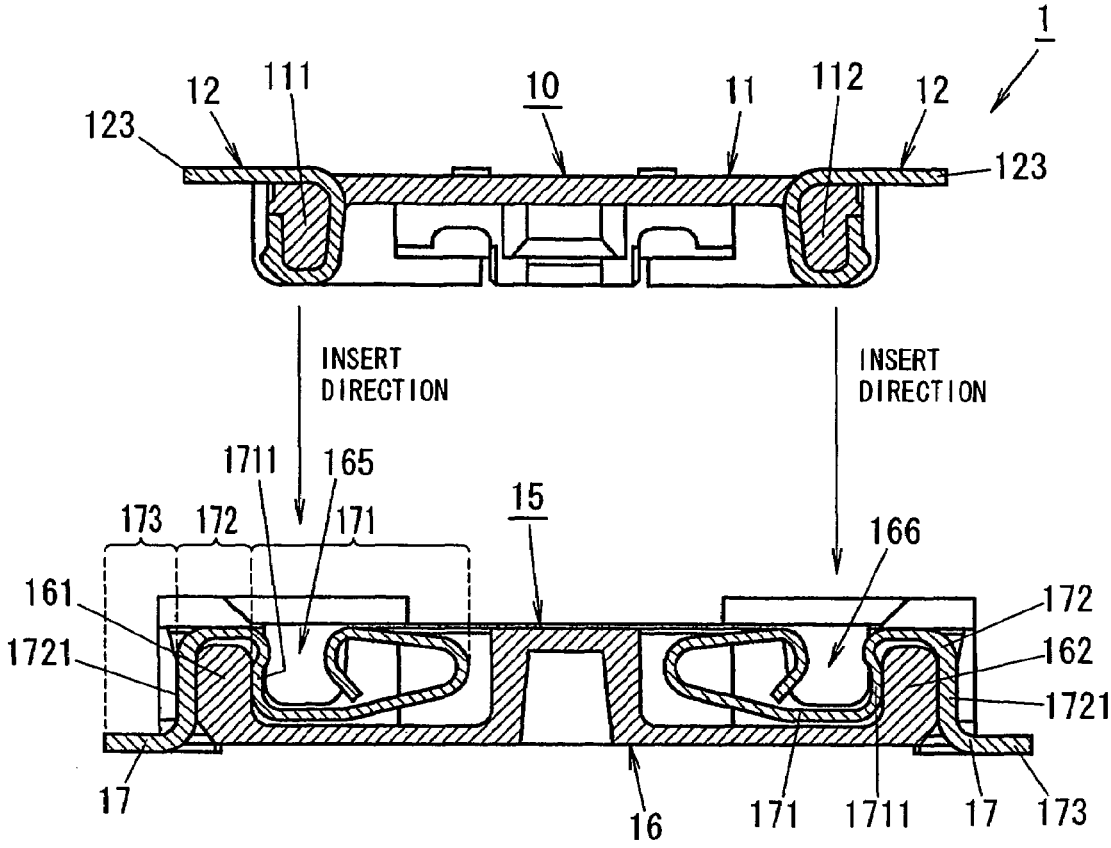
FIG. 1A PRIOR ART
FIGS. 1A and 1B are sectional views of a header connector and a socket connector constituting a prior art connector.
Figure 1B:
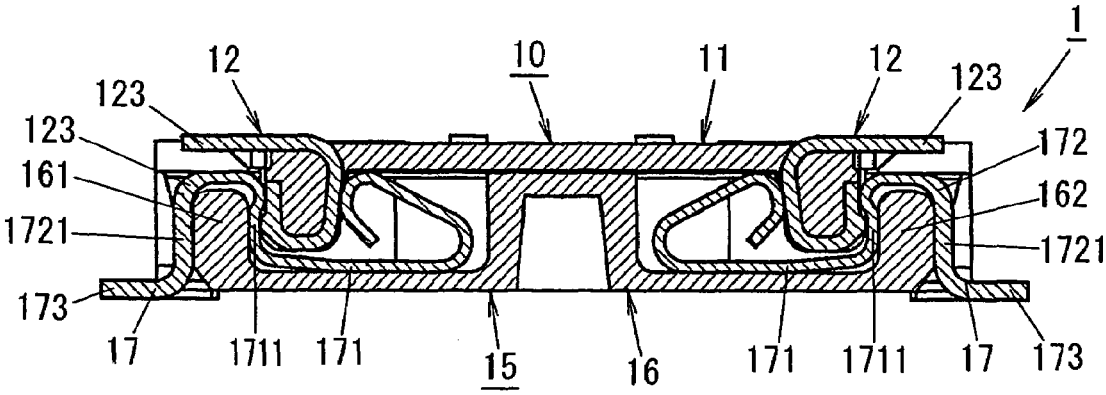
FIG. 1B PRIOR ART
Figure 2A:
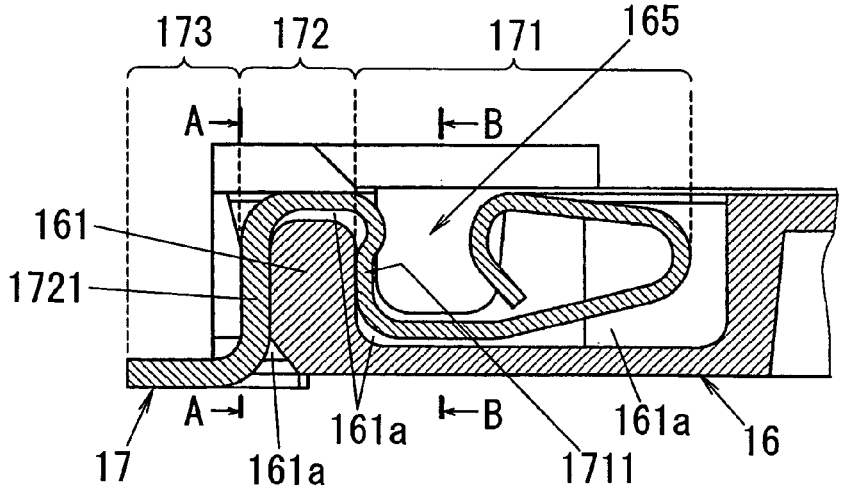
FIG. 2A PRIOR ART
FIGS. 2A, 2B and 2C are an enlarged sectional view of the socket connector, a sectional view along line A-A of FIG. 2A, and a sectional view along line B-B of FIG. 2A, respectively.
Figure 2B:
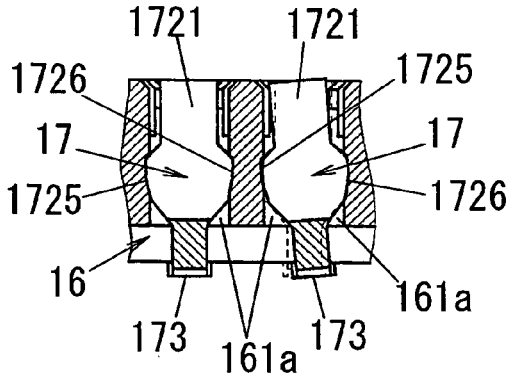
FIG. 2B PRIOR ART
Figure 2C:
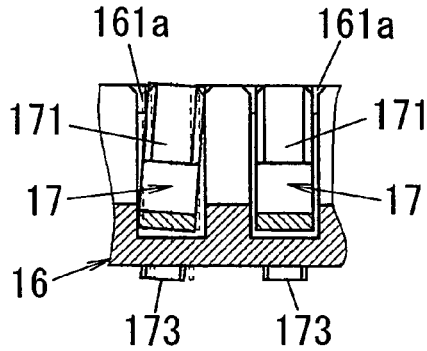
FIG. 2C PRIOR ART
Figure 3:
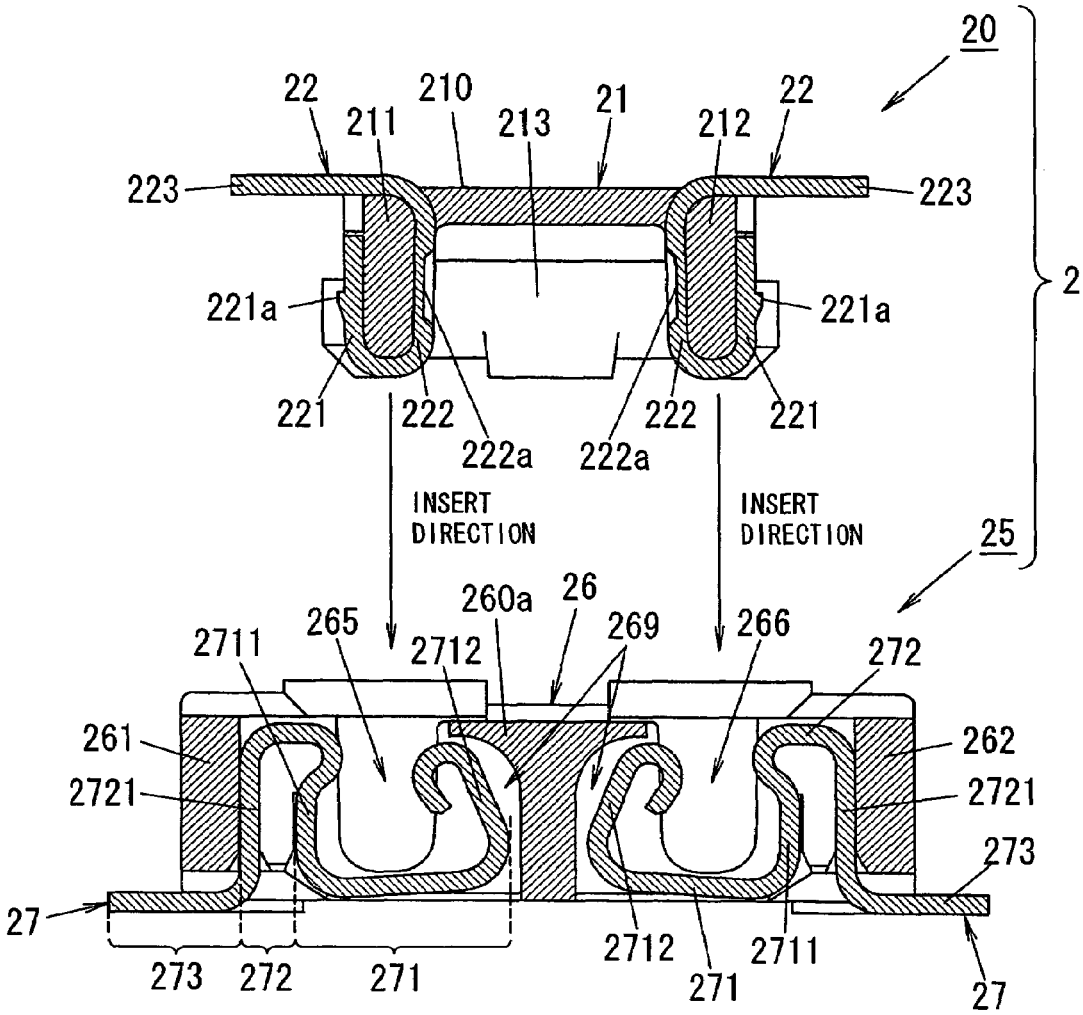
FIGS. 3 and 4 are sectional views of an embodiment according to the present invention.

FIG. 3 shows an embodiment according to the present invention, namely a connector 2. The connector 2 comprises a header connector 20 and a socket connector 25.

The header connector 20 is constructed with a header housing 21 formed of electrically insulating material such as synthetic resins or the like and header contacts 22 each of which is made of a conductive metal plate.

Figure 5:
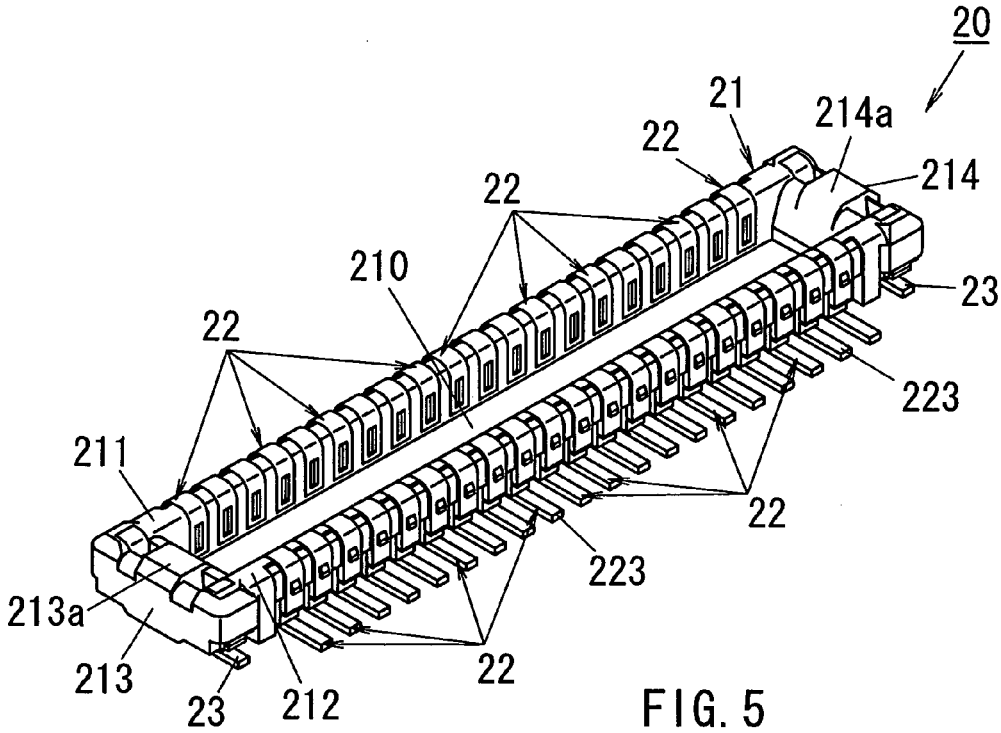
FIG. 5 is a perspective view of a header connector of the embodiment.

As shown in FIGS. 3 and 5, the housing 21 is formed into a slender box shape with a base 210, and four walls (sides) 211-214 along an insert direction. The housing 21 is also provided with attaching terminals 23 soldered to, for example, a printed circuit board at the four corners thereof.

Figure 4:
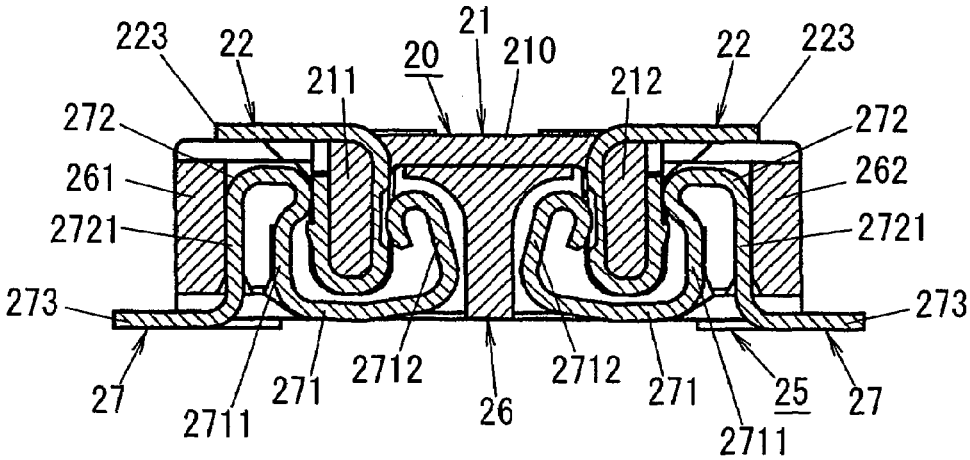

The contacts 22 are arranged and fixed at specified intervals on the lengthwise walls 211 and 212 of the housing 21 by, for example, insert molding. That is, each contact 22 is bent so that both faces of a lengthwise wall are sandwiched between the bent two parts of the contact 22, and then is fixed on the wall. In the example of FIGS. 3-5, the housing 21 retains P-shaped contacts 22 each of which foot section 223 as, for example, a lead connected to a printed circuit board sticks out sideways via a through hole of the housing 21. In addition, one end (tip) of the head of each contact 22 is provided with a pawl 221*a* formed so that the contact 22 is restrained from moving toward the opposite direction of the insert direction, while other end 222 of the head is formed with a dent 222*a* that is V-shaped in cross section perpendicular to the insert direction.

Figure 6:
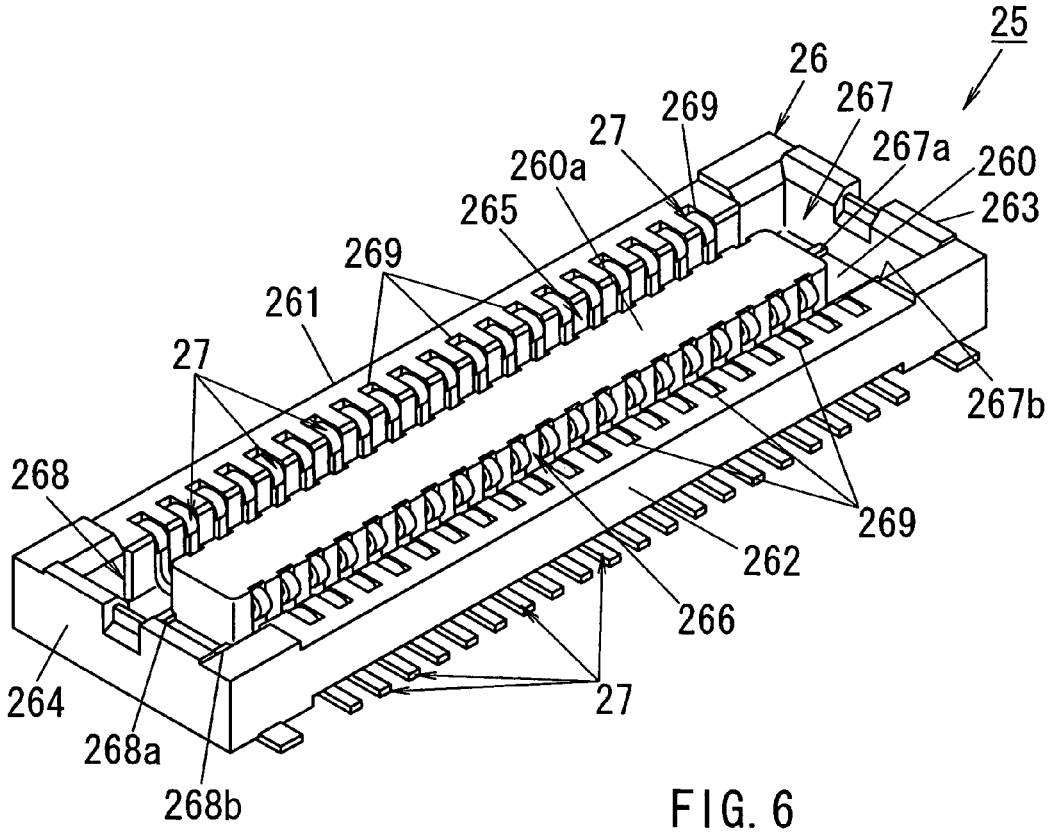
FIG. 6 is a perspective view of a socket connector of the embodiment.
Figure 7A:
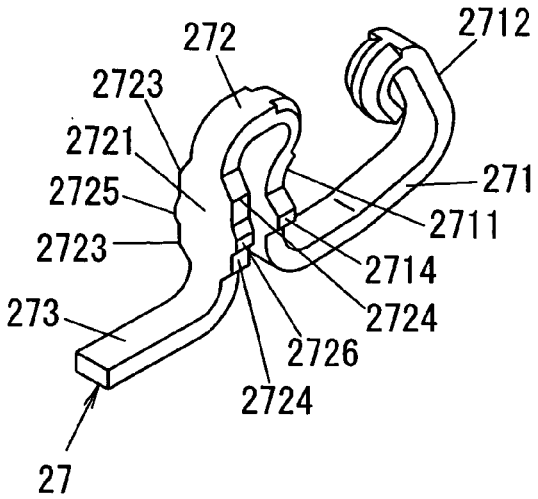
FIGS. 7A and 7B are perspective views of a socket contact of the embodiment.
Figure 7B:
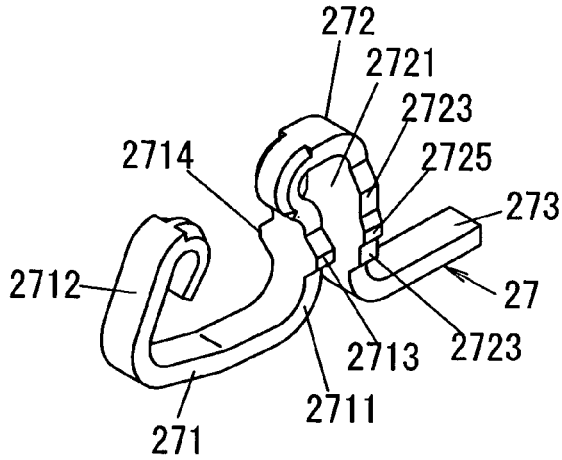

As shown in FIGS. 3, 4 and 6, the socket connector 25 is constructed with a socket housing 26 formed of electrically insulating material such as synthetic resins or the like and resilient socket contacts 27 each of which is made of a conductive metal plate.

The housing 26 is formed into a slender box shape of which four walls 261-264 surround the walls 211-214 of the housing 21 and of which base 260 closes the opening of the housing 21. The base (bottom) 260 in the housing 26 is also formed with an island 260*a*, and the base 260, the island 260*a* and the walls 261-264 form connection cavities 265 and 266 into which the walls 211 and 212 fixing the header contacts 22 are inserted as well as forming receiving cavities 267 and 268 into which the walls 213 and 214 are inserted.

The contacts 27 are arranged and fixed at the above specified intervals along the lengthwise walls 261 and 262 on the housing 26. Each contact 27 is formed to include a U-shaped contact section 271, an L-shaped fixed section 272 and an I-shaped lead section 273, as shown in FIGS. 3, 4, 7A and 7B.

The contact section 271 is bent so that the header contact 22 inserted into a corresponding connection cavity is sandwiched between the semi-circle shaped tip 2711*a* of one end 2711 and the hook shaped tip 2712*a* of other end 2712 of the section 272 and the tips come in contact with the contact 22. The hook shaped tip of the other end 2712 has a convex curved surface that comes in contact with the opening edge of the dent 222*a* of a corresponding contact 22. Accordingly, even if a foreign body clings to the other end 222 of the head of the contact 22 or the other end 2712 of the contact section 271 of the contact 27, the foreign body is pushed by the hook shaped tip of other end 2712 to be dropped into the dent 222*a* of the contact 22 when the contacts 22 and 27 come in contact with each other. Therefore, since the foreign body can prevent from being sandwiched between the contacts 22 and 27, it is possible to improve the connection reliability between the connectors 20 and 25.

Figure 8:
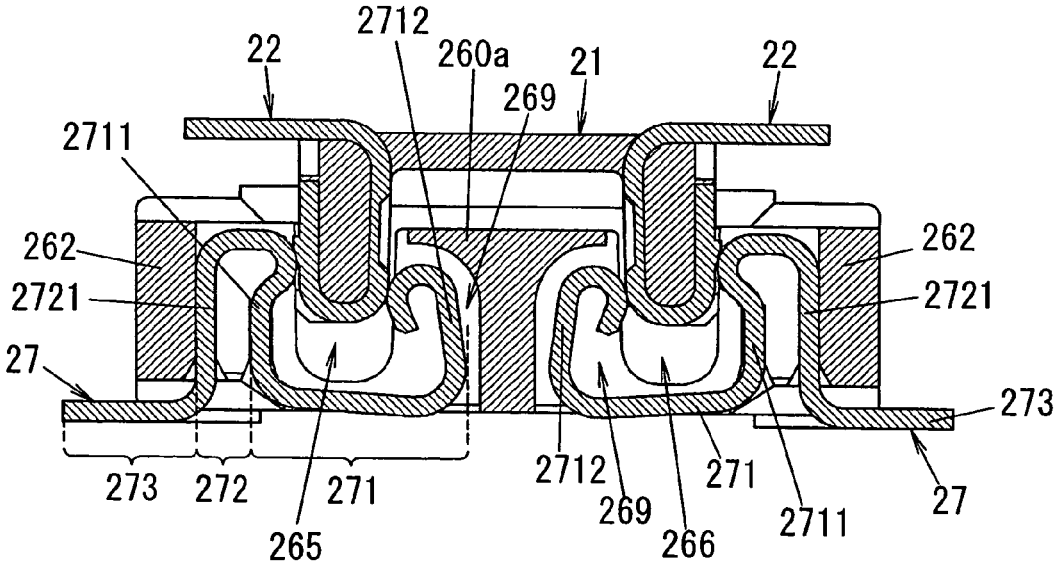
FIG. 8 is a sectional view of the header connector and the socket connector of the embodiment when combined with each other.
Figure 9A:
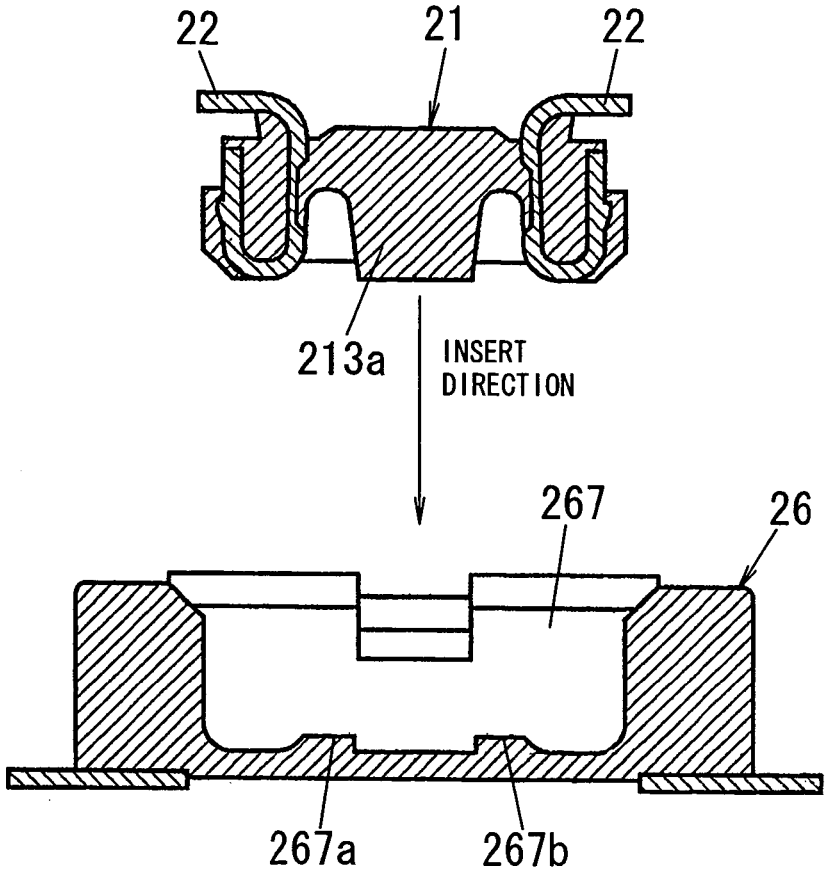
FIGS. 9A and 9B are sectional views in a receiving cavity of the embodiment.
Figure 9B:
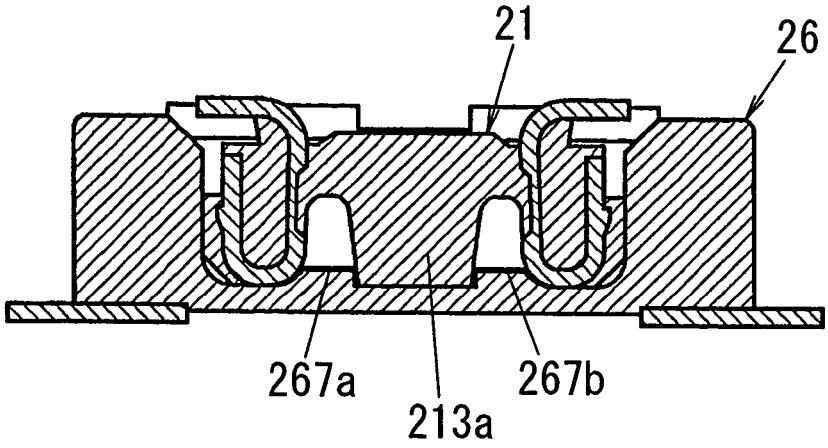
Figure 10A:
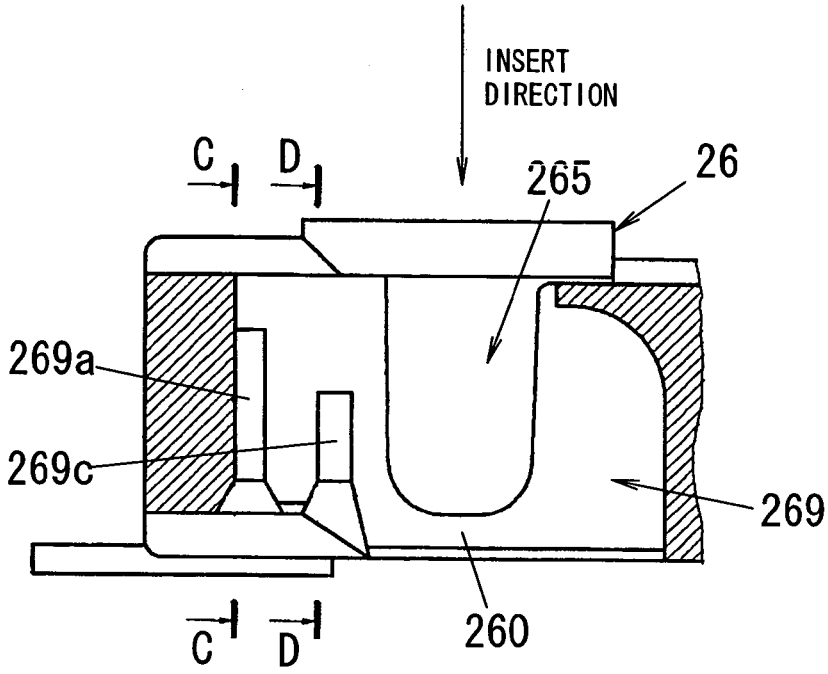
FIGS. 10A, 10B and 10C are an enlarged sectional view of a socket housing of the embodiment, a sectional view along line C-C of FIG. 10A, and a sectional view along line D-D of FIG. 10A, respectively.
Figure 10B:
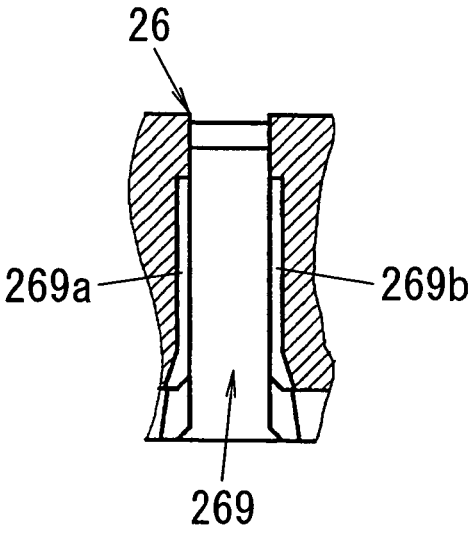
Figure 10C:
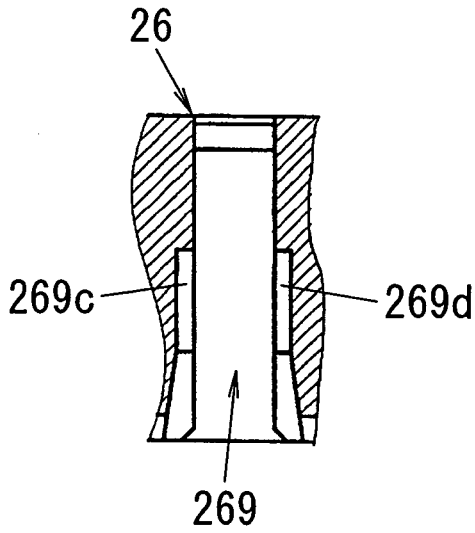

In addition, the contact section 271 is formed so that the tip (other end 2712) side of the section 271 tilts to the opposite direction of the insert direction and a part of the hook shaped tip of the other end 2712 protrudes from the after-mentioned slot 269 to the insert route of a corresponding contact 22, as shown in FIG. 3. As shown in FIGS. 8 and 4, when the walls 211-214 of the connector 20 are respectively inserted into the cavities 265-268 of the connector 25, the pawls 221*a* of the contacts 22 respectively climb over the semi-circle shaped tips of the contacts 27 and also the hook shaped tips of the contacts 27 respectively fit in the dents 222*a* of the contacts 22. At this point, click feel is obtained. In the condition of FIG. 4, each resilient contact section 271 is elastically deformed so as to spread the ends 2711 and 2712, and therefore sandwiches a corresponding contact 22 between the ends 2711 and 2712 of which tips come in contact therewith, while adding restoring force of the elastic deformation.

The fixed section 272 is continuously formed at the tip of the one end 2711 so that a part (one end) 2721 of the section 272 is arranged in parallel with the one end 2711.

The lead section 273 is continuously formed at the tip of the part 2721 so as to stick out sideways, and is connected to, for example, a printed circuit board.

As shown in FIGS. 5, 6, 9A and 9B, in order to firmly fix the header housing 21 and the socket housing 26 to each other, the housing 21 is formed with racks 213*a* and 214*a*, while the housing 26 is formed with a pair of rack stoppers 267*a* and 267*b* and a pair of rack stoppers 268*a* and 268*b* for fixing the rack 213*a* and the rack 214*a*, respectively. The racks 213*a* and 214*a* are formed so as to stick out from the end faces of the widthwise walls 213 and 214, respectively. The rack stoppers 267*a* and 267*b* are formed so as to stick out from the bottom of the housing 26 (i.e., receiving cavity 267), and when the connectors 20 and 25 are combined, the tip of the rack 213*a* inserted into the cavity 267 is sandwiched and fixed between the rack stoppers 267*a* and 267*b*. The rack stoppers 268*a* and 268*b* are also formed so as to stick out from the bottom of the housing 26 (i.e., receiving cavity 268), and when the connectors 20 and 25 are combined, the tip of the rack 214*a* inserted into the cavity 268 is sandwiched and fixed between the rack stoppers 268*a* and 268*b*. Accordingly, the housings 21 and 26 can be firmly fixed to each other, and especially it is possible to prevent any one of the connectors 20 and 25 from shifting widthwise with respect to the other and the stress is absorbed by the racks and the rack stoppers and therefore mechanical strength of the connector 2 is improved. Moreover, around the rack stoppers each of which receives the stress can be reinforced with the thickness thereof, and also molding is simple because of simple structure of drawing.

As shown in FIGS. 6, 10A, 10B, 10C and 11A, in order to properly fix each socket contact 27 to the socket housing 26, the housing 26 is further provided with through slots 269 along the insert direction. Each of the slots 269 is larger than the width size of each socket contact 27 (width size excepts the after-mentioned each projection) and also has a pair of facing retention grooves 269*a* and 269*b* and a pair of facing guiding grooves 269*c* and 269*d* along the insert direction on its facing surfaces in which a connection cavity is formed, respectively. That is, each of the connection cavities 265 and 266 is formed with the slots 269 through which are bored along the insert direction on the base (bottom) 260 and lengthwise facing surfaces in the connection cavity. Each of the grooves is opened toward the insert direction.

Figure 11A:
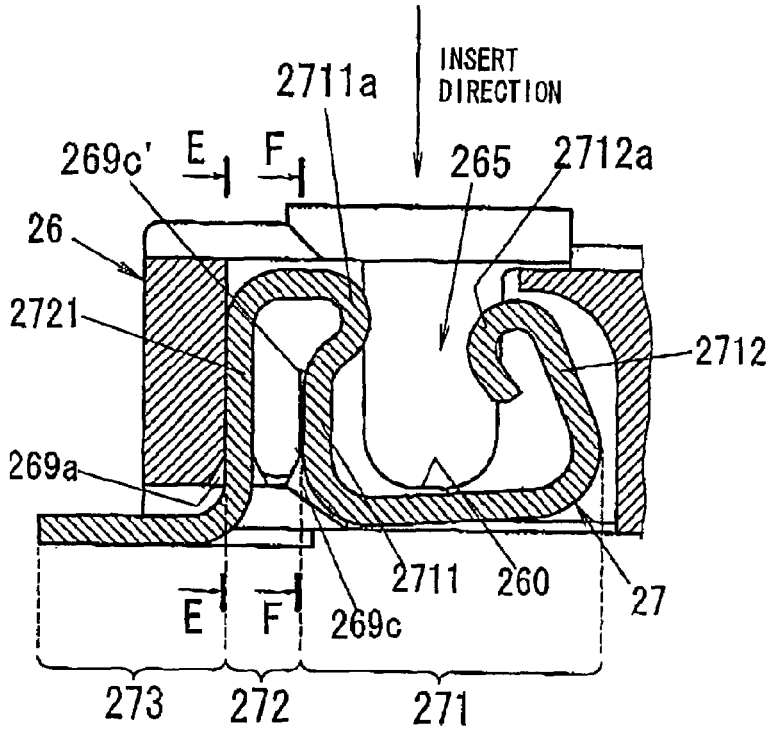
FIGS. 11A, 11B and 11C are an enlarged sectional view of the socket connector of the embodiment, a sectional view along line E-E of FIG. 11A, and a sectional view along line F-F of FIG. 11A, respectively.
Figure 11B:
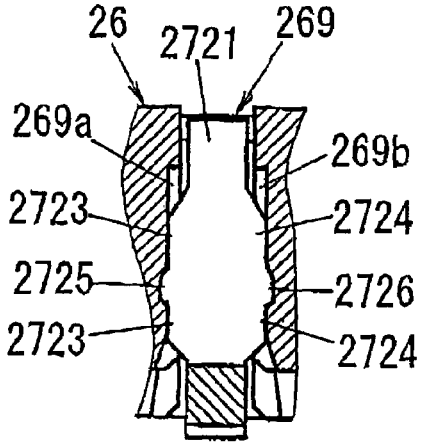
Figure 11C:
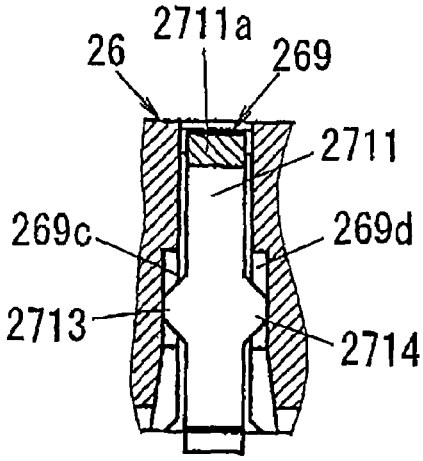

As shown in FIGS. 11A, 11B and 11C, each socket contact 27 is formed with a pair of guide projections 2723 and 2724 and a pair of retention projections 2725 and 2726 at the both sides of the part 2721 of the fixed section 272, respectively. The projections 2723 and 2724 have end faces that include corner cut regions for insert assistance and substantially come in contact with the bottoms of corresponding retention grooves 269*a* and 269*b*, respectively, and are guided along the grooves 269*a* and 269*b*. The projections 2725 and 2726 are formed to stick out from the middles of the projections 2723 and 2724 and to include corner cut regions for insert assistance, respectively. Concretely, the length between the end faces of the projections 2723 and 2724 is slightly shorter than that between the bottoms of the grooves 269*a* and 269*b*. Inversely, the length between the end faces of the projections 2725 and 2726 is slightly longer than that between the bottoms of the grooves 269*a* and 269*b*, and therefore the both sides of the part 2721 of the fixed section 272 are pressed into the grooves 269*a* and 269*b* of a corresponding slot 269. Each contact 27 is also formed with a pair of guide projections 2713 and 2714 at the both sides of the one end 2711 of the contact section 271, respectively. The projections 2713 and 2714 have end faces that include corner cut regions for insert assistance and substantially come in contact with the bottoms of corresponding guiding grooves 269*c* and 269*d*, respectively, and are guided along the grooves 269*c* and 269*d*. That is, the length between the end faces of the projections 2713 and 2714 is slightly shorter than that between the bottoms of the grooves 269*c* and 269*d*.

The socket contacts 27 formed in that way are respectively put in the slots 269 of the housing 26 from the opposite direction of the insert direction. At this point, the guide projections 2723 and 2724 of a contact 27 are respectively guided along the retention grooves 269*a* and 269*b* of a slot 269, while the guide projections 2713 and 2714 of the contact 27 are respectively guided along the guiding grooves 269*c* and 269*d* of the slot 269, and the both sides of the part 2721 of the fixed section 272, namely the retention projections 2725 and 2726 are meanwhile pressed into the grooves 269*a* and 269*b* of the slot 269, respectively. In particular, in a state that the end faces of the projections 2723 and 2724 of the fixed section 272 substantially come in contact with the bottoms of the grooves 269*a* and 269*b* of the housing 26, the projections 2725 and 2726 of the fixed section 272 are sank into the bottoms of the grooves 269*a* and 269*b*, and thereby the contact 27 is firmly retained to the housing 26. Moreover, the housing 26 sandwiches and receives both sides of the one end 2711 of the contact section 271 between the grooves 269*c* and 269*d* so that the one end 2711 can only move along the facing surfaces with the above grooves of the slot 269. The end faces of the projections 2713 and 2714 of the one end 2711 substantially come in contact with the bottoms of the grooves 269*c* and 269*d* in particular and thereby it is possible to prohibit the contact section 271 from moving along the length direction of the housing 26. Therefore, since each contact 27 can prohibited from rotating around the direction perpendicular to the lengthwise walls of the housing 26, each contact 27 can be properly fixed to the housing 26.

In addition, guiding grooves 269*c* and 269*d* of each slot 269 have widths wider than the thickness of the one end 2711 of each contact section 271 and have buffer gaps at sides of the neighboring retention grooves 269*a* and 269*b* when the header connector 20 and the socket connector 25 are separated, respectively. Accordingly, when the part of the hook shaped tip of each contact 27 (other end 2712) is pushed toward the insert direction by a contact 22 fixed to the housing 21, the other end 2712 can more retreat along the insert direction as shown in FIG. 8, and therefore it is possible to more reduce handling force when the connectors 20 and 25 are combined or separated.

Although the present invention has been described with reference to certain preferred embodiments, numerous modifications and variations can be made by those skilled in the art without departing from the true spirit and scope of this invention.

The invention claimed is:

1. An electrical connector assembly comprising:

a header connector having a header housing and at least a header contact;

the housing having a wall along an insert direction;

the header contact being bent so that both faces of the wall are sandwiched between the bent two parts of the header contact, and then fixed on the wall;

a socket connector having at least a resilient socket contact and a socket housing having a connection cavity formed so that the wall fixing the header contact is inserted into the cavity and pulled out thereof along the insert direction; and, the socket contact including a contact section bent so that the header contact inserted into the cavity is sandwiched between both ends of the contact section and the ends come in contact with the header contact;

wherein the socket contact further includes a fixed section that is formed to extend from the tip of one end of the contact section so that a part of the fixed section is arranged in parallel with the one end, said part of the fixed section existing at the tip side of the fixed section;

the socket housing is formed with a pair of facing retention grooves and a pair of facing guiding grooves along the direction on facing surfaces in the cavity, respectively, said socket housing sandwiching and retaining both sides of the part of the fixed section between the retention grooves, said socket housing also sandwiching and receiving both sides of the one end of the contact section between the guiding grooves so that the one end of the contact section can only move along said facing surfaces in the cavity; and, each of the guiding grooves has a width wider than the thickness of the one end of the contact section and has a buffer gap at a side of the neighboring retention groove when the wall fixing the header contact is not inserted into the cavity, all of the one end of contact section being movable to a side of the part of the fixed section through the buffer gap.

2. The connector of claim 1, wherein the socket housing further comprises a through slot along the insert direction, said slot having facing surfaces as said facing surfaces in the cavity and is formed at the bottom and another facing surfaces in the cavity;

the socket contact is put in the slot; and the retention grooves and the guiding grooves are opened toward the insert direction.

3. The connector of claim 1, wherein:

the both sides of the one end of the contact section are formed with a pair of guide projections that are guided along the guiding grooves and substantially come in contact with the guiding grooves, respectively, while the both sides of the part of the fixed section are formed with a pair of guide projections guided along the retention grooves and a pair of retention projections pressed into the retention grooves, respectively.

4. The connector of claim 1, wherein:

the header housing further includes another wall along the insert direction, the end face of the another wall being formed with a rack that sticks out along the insert direction; and the socket housing further includes a receiving cavity in which said another wall is received, the bottom of the receiving cavity being formed with a pair of rack stoppers that stick out along the insert direction so that the tip of the rack is sandwiched between the stoppers when the wall fixing the header contact is inserted into the connection cavity.

* * * * *